US010930429B1

(12) United States Patent
Folker et al.

(10) Patent No.: US 10,930,429 B1
(45) Date of Patent: Feb. 23, 2021

(54) TUNABLE MAGNETIC CORE STRUCTURE

(71) Applicant: Universal Lighting Technologies, Inc., Madison, AL (US)

(72) Inventors: Donald Folker, Madison, AL (US); Travis L. Berry, Madison, AL (US); Mike LeBlanc, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 337 days.

(21) Appl. No.: 15/887,409

(22) Filed: Feb. 2, 2018

Related U.S. Application Data

(60) Provisional application No. 62/455,150, filed on Feb. 6, 2017.

(51) Int. Cl.

| | |
|---|---|
| ***H01F 29/10*** | (2006.01) |
| ***H01F 27/28*** | (2006.01) |
| ***H01F 41/02*** | (2006.01) |
| ***H01F 27/32*** | (2006.01) |
| *H01F 27/29* | (2006.01) |

(52) U.S. Cl.
CPC ..... *H01F 29/10* (2013.01); *H01F 27/28* (2013.01); *H01F 27/325* (2013.01); *H01F 41/0206* (2013.01); *H01F 27/29* (2013.01)

(58) Field of Classification Search
CPC ..... H01F 27/325; H01F 27/29; H01F 27/24; H01F 27/324; H01F 27/266; H01F 27/2823; H01F 2027/297; H01F 5/02; H01F 2005/022; H01F 2005/046; H01F 27/292
USPC ..... 336/192, 196, 198, 208, 212, 221
See application file for complete search history.

(56) References Cited

U.S. PATENT DOCUMENTS

| | | | | |
|---|---|---|---|---|
| 3,267,401 | A * | 8/1966 | Hotine | H01F 21/06 336/136 |
| 5,347,255 | A * | 9/1994 | Saitoh | H01F 21/06 336/134 |
| 5,760,670 | A * | 6/1998 | Yeh | H01F 27/24 336/134 |
| 9,799,442 | B1 | 10/2017 | Folker et al. | |
| 9,842,683 | B1 | 12/2017 | LeBlanc et al. | |
| 2003/0080844 | A1* | 5/2003 | Nishikawa | H01F 27/306 336/178 |
| 2013/0120099 | A1* | 5/2013 | An | H01F 27/325 336/221 |

* cited by examiner

*Primary Examiner* — Tszfung J Chan
(74) *Attorney, Agent, or Firm* — Patterson Intellectual Property Law, P.C.; Gary L. Montle; Jerry Turner Sewell

(57) ABSTRACT

A tunable magnetic assembly includes a bobbin, an outer core, and an inner core. The bobbin has a first and second flanges. The bobbin has a passageway extending between the first and second flange. The passageway has a spiral track defined in a passageway surface. The outer core is positioned around the first and second flanges. The outer core includes an opening positioned near the first flange. The inner core is positioned in the opening and in the cylindrical passageway. The inner core includes at least one protrusion extending from an outer surface and configured to engage the spiral track. A gap distance is defined between the inner core and a portion of the outer core near the second flange. The gap distance is adjustable by moving the protrusion within the spiral track. Adjusting the gap distance modifies the inductance.

13 Claims, 6 Drawing Sheets

TUNABLE MAGNETIC CORE STRUCTURE

CROSS-REFERENCES TO RELATED APPLICATIONS

This application claims benefit of the following patent application which is hereby incorporated by reference: U.S. Provisional Patent Application No. 62/455,150 filed Feb. 6, 2017, entitled "Tunable Magnetic Core Structure."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present disclosure relates generally to magnetic assembly structures. More particularly, the present disclosure relates to a tunable magnetic assembly structure and a method of tuning.

BACKGROUND OF THE INVENTION

Currently, magnetic assemblies are made with two "E" shaped cores, with the center leg of each core inserted into a bobbin from respective ends of the bobbin. The exposed end of the center leg of each "E" core is ground to reduce the length of the center leg with respect to the outer legs of the core. Thus, when the mating ends of the outer legs of the two cores meet outside the bobbin, the mating ends of the center legs are offset by a small amount to create a gap between the cores approximately at the center of the bobbin. The size of the gap directly relates to the inductance of the magnetic assembly. A smaller gap corresponds to a larger inductance, while a larger gap corresponds to a smaller inductance. The center leg gap is located directly below the center of the winding. The stray field from the gap creates loss in the winding. The cores must be glued or taped together. The "E" structure has three mating surfaces, one on the center leg and two on the outer legs. It is not easy to change the inductance of this magnetic assembly. To decrease the inductance, the two "E" cores must be removed from the bobbin and a portion of the center leg ground to shorten the center leg. The two cores are inserted back into the bobbin. To increase the inductance, the two "E" cores are removed and replaced with two "E" core with a smaller air gap.

What is needed, then, is a new magnetic assembly that allows for efficient and easy adjustment of the gap. The new magnetic assembly would also benefit from positioning the gap outside of the winding area.

BRIEF SUMMARY OF THE INVENTION

One embodiment disclosed herein is a magnetic assembly for easy inductance adjustment. The magnetic assembly includes a bobbin, an inner core, and an outer core. The bobbin has a first end flange, a second end flange, and a cylindrical passageway. The cylindrical passageway extends through the bobbin from the first end flange to the second end flange. The cylindrical passageway has a passageway surface and a passageway length, both defined between the first end flange and the second end flange. The passageway has at least one spiral track etched in the passageway surface. The at least one spiral track spans a first portion of the passageway length. The outer core is positioned around the first and second end flanges. The outer core has a first end wall. The first end wall has a first inner surface positioned adjacent to the first end flange. The first end wall further includes an opening. The outer core has a second end wall. The second end wall has a second inner surface positioned adjacent to the second end flange. The cylindrical inner core is positioned in the passageway of the bobbin. The cylindrical inner core has a first end surface, a second end surface, and an outer surface. The outer surface is defined between the first end surface and the second end surface. The first end surface is accessible through the opening in the first end wall. The second end surface is positioned near the second end wall. The cylindrical inner core further includes at least one protrusion extending from the outer surface. The at least one protrusion is configured to slidably engage the at least one spiral track. A gap distance is defined between the second end surface of the cylindrical inner core and the second inner surface of the outer core.

The magnetic assembly is configured so that the gap distance is adjustable.

The magnetic assembly has at least one winding wound about the passageway between the first end flange and the second end flange.

In certain embodiments, the magnetic assembly has a drive interface defined in the first end surface. The drive interface is engageable with an engagement tool. The engagement tool is used to selectively move the at least one protrusion within the at least one spiral track.

The magnetic assembly has a track profile and a protrusion profile. The track profile and the protrusion profile are configured such that the at least one protrusion is configured to slidably move within the at least one spiral track.

In certain embodiments, the magnetic assembly is configured such that the at least one protrusion of the inner core includes a first protrusion and a second protrusion. The second protrusion extends from an opposite side of the outer surface. The first and second protrusions are offset by an offset distance parallel with an inner core length. The offset distance is configured to enable both the first protrusion and the second protrusion to slidably engage the at least one track.

In certain embodiments, the first end surface of the cylindrical inner core is configured to extend at least partially through the opening of the first end wall of the outer core.

In certain embodiments, the opening of the first end wall of the outer core is configured to extend to a lower surface of the outer core.

In certain embodiments, the magnetic assembly has at least one straight track etched in the passageway surface. The at least one straight track spans a second portion of the passageway length. The second portion at least partially overlaps the first portion of the passageway length.

In certain embodiments, the magnetic assembly has the at least one straight track configured to include a first straight track and a second straight track. The second straight track may be positioned diametrically across the passageway from the first straight track.

In certain embodiments, the magnetic assembly has at least one crushable flange rib disposed on an outer flange surface of each of the first and second end flanges.

In certain embodiments, the magnetic assembly is configured such that the at least one crushable flange rib is tapered.

The magnetic assembly is configured to have the outer core configured to crush and frictionally engage the at least one crushable flange rib. The frictional engagement secures the outer core to the bobbin.

Another embodiment disclosed herein is a method of tuning the inductance of a magnetic component. The method includes the step of providing a bobbin. The bobbin has a first outer flange. The bobbin further has a second outer flange opposite to the first outer flange. The bobbin has cylindrical passageway extending between the first outer flange and the second outer flange. The bobbin has a spiral track defined in the passageway surface between the first outer flange and the second outer flange. The method includes the step of positioning an integrally formed outer core around the first and second end flanges of the bobbin. The outer core includes an opening positioned near the first outer flange. The opening may be configured to align with the cylindrical passageway. The method includes the step of positioning a cylindrical inner core in the passageway of the bobbin. The cylindrical inner core has a first end surface. The first end surface may be accessible through the opening in the outer core. The cylindrical inner core may also have a second end surface positioned opposite the first end surface. The cylindrical inner core includes at least one protrusion positioned between the first end surface and the second end surface. The at least one protrusion may be configured to engage the spiral track. The method includes the step of turning the cylindrical inner core to adjust a gap distance defined between second end surface and the outer core.

In certain embodiments, the method of tuning the inductance of the magnetic component also includes the step of engaging a drive interface defined on the first end surface of the cylindrical inner core. The step of engaging the drive interface may rotate the inner core within the passageway and cause the inner core to move longitudinally within the passageway.

In certain embodiments, the method of tuning the inductance of the magnetic component also includes the step of turning the inner core clockwise to move the at least one protrusion within the spiral track. The step of turning the inner core clockwise may decrease the gap distance and increase the inductance. Such a method may also include the step of turning the inner core counter-clockwise to move the at least one protrusion within the spiral track. The step of turning the inner core counter-clockwise may increase the gap distance and decrease the inductance.

In certain embodiments, the method of tuning the inductance of the magnetic component also includes the step of measuring an inductance of the magnetic component at a first gap distance. Such a method may also include the step of recording the inductance and the gap distance associated with the inductance measurement. Such a method may also include the step of tuning the inductance by adjusting the gap distance.

In another embodiment, a method of assembling a magnetic assembly is provided. The method of assembling the magnetic assembly includes the step of providing a bobbin. The bobbin has a cylindrical passageway with at least one winding wound thereon. The at least one winding may be wound between a first end flange and a second end flange. The passageway has a passageway surface. The passageway surface has at least one spiral track disposed thereon. The at least one spiral track may be positioned between the first end flange and the second end flange. The method of assembling the magnetic assembly includes the step of positioning a cylindrical inner core within the passageway of the bobbin by moving at least one protrusion of the inner core within the at least one spiral track of the passageway. The method of assembling the magnetic assembly includes the step of positioning an outer core around the first and second end flanges. The outer core has a first end wall positioned near the first end flange. The first end wall has a first inner surface. The first inner surface has an opening. The first end surface of the inner core is configured to be receive in and accessible through the opening. The outer core has a second end wall positioned near the second end flange. The second end wall has a second inner surface. The second inner surface is spaced apart from the second end surface of the inner core. A gap is defined between the second end wall of the inner core and the second inner surface of the outer core.

In certain embodiments, the method of assembling the magnetic assembly also includes the step of positioning a cylindrical inner core within the passageway of the bobbin by moving at least one protrusion of the inner core within at least one straight track defined in the passageway surface.

DETAILED DESCRIPTION OF THE INVENTION

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Reference will now be made in detail to embodiments of the present disclosure, one or more drawings of which are set forth herein. Each drawing is provided by way of explanation of the present disclosure and is not a limitation. It will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

It is intended that the present disclosure covers such modifications and variations as come within the scope of the appended claims and their equivalents. Other objects, features, and aspects of the present disclosure are disclosed in the following detailed description. It is to be understood by one of ordinary skill in the art that the present discussion is a description of exemplary embodiments only and is not intended as limiting the broader aspects of the present disclosure.

A magnetic assembly 100 is shown in FIGS. 1-5. The magnetic assembly 100 may be referred to as a magnetic component 100 or a tunable magnetic assembly 100.

Figure 5:
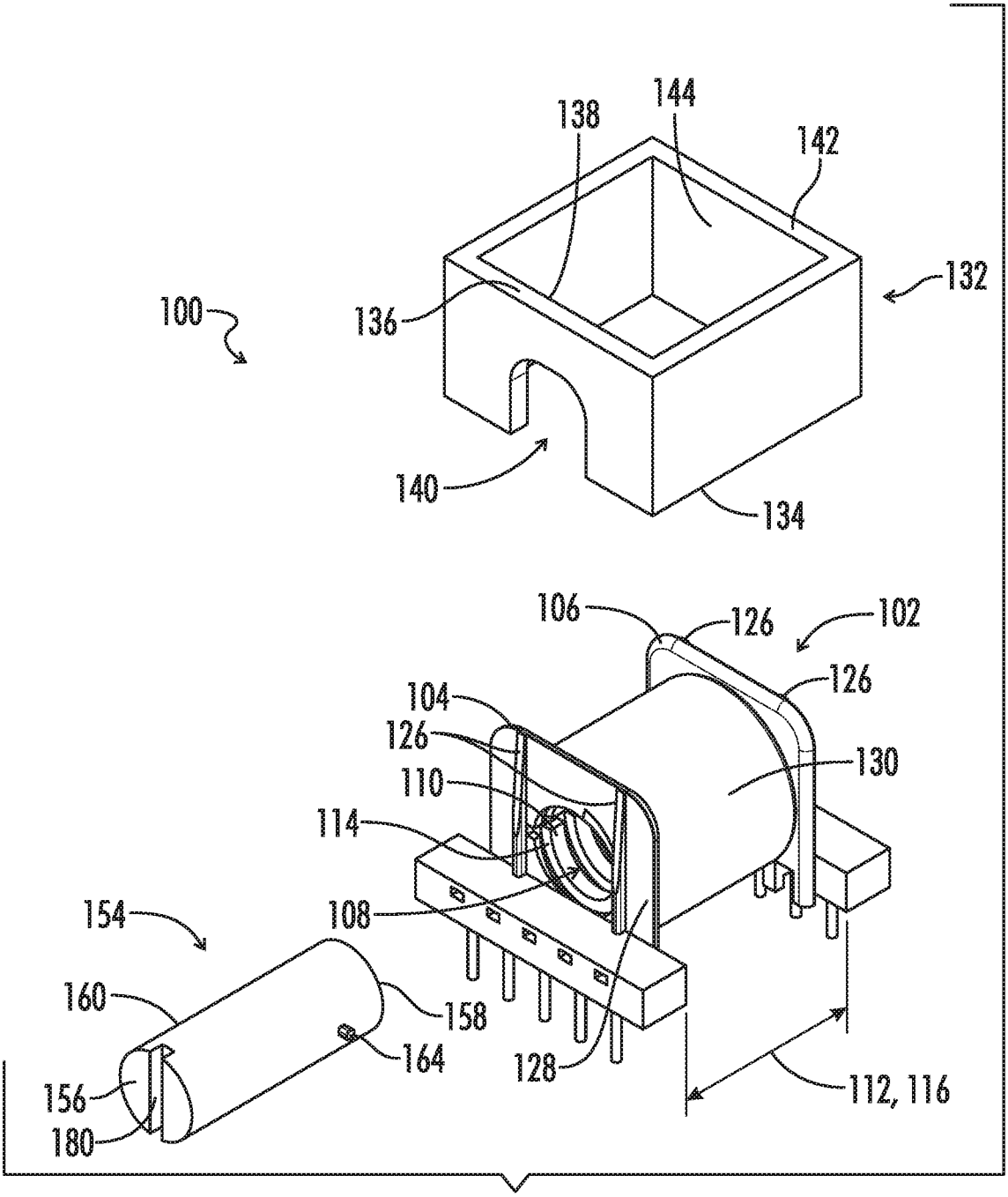
FIG. 5 illustrates an exploded perspective view of the magnetic assembly of FIG. 1.

In the illustrated embodiment, the magnetic assembly 100 includes a bobbin 102 having a first outer flange 104 and a second outer flange 106 opposite the first outer flange 104. The first outer flange 104 may be referred to as a first end flange 104. The second outer flange 106 may be referred to as a second end flange 106. As shown in FIG. 5, the bobbin 102 further includes a cylindrical passageway 108. The cylindrical passageway 108 extends between the first outer flange 104 and the second outer flange 106. The passageway 108 has a passageway surface 110 and a passageway length 112 defined between the first outer flange 104 and the second outer flange 106. The passageway 108 further has at least one spiral track 114 defined in the passageway surface 110. The at least one spiral track 114 spans a first portion 116 of the passageway length 112. In certain embodiments (not shown), the at least one spiral track may be shaped differently.

Figure 7:
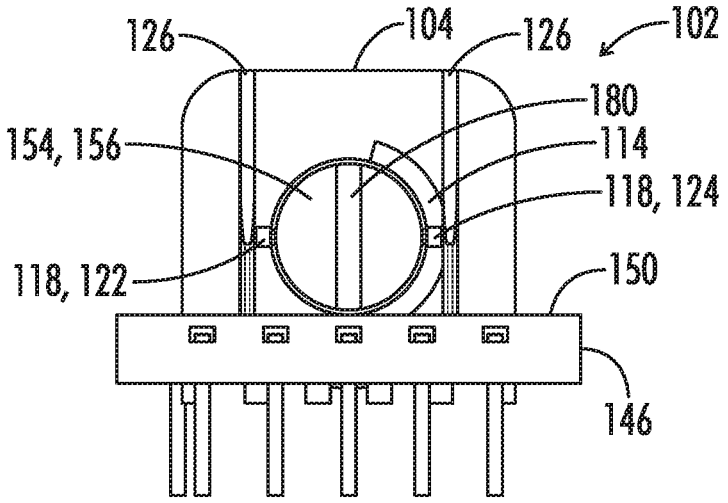
FIG. 7 illustrates a front elevational view of the bobbin with the center core partially inserted as shown in FIG. 6.
Figure 8:
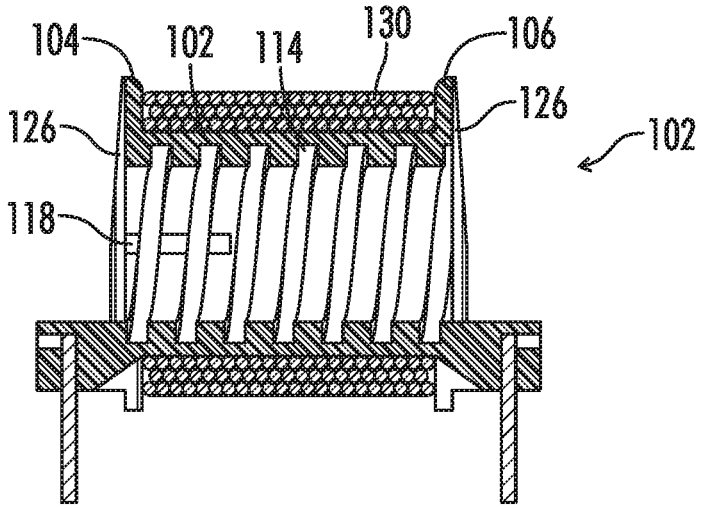
FIG. 8 is illustrates a cross-sectional right side elevational view of the bobbin of FIG. 6.
Figure 9:
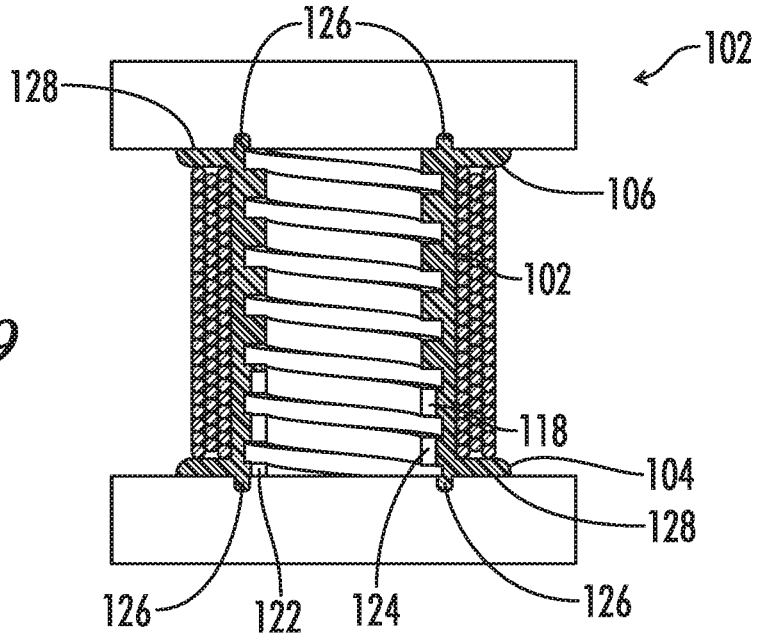
FIG. 9 illustrates a cross-sectional top plan view of the bobbin of FIG. 6.

As shown in FIGS. 7-9, the bobbin 102 includes at least one straight track 118 defined in the passageway surface 110. The at least one straight track 118 spans a second portion 120 of the passageway length 112. The second portion 120 of the passageway length 112 overlaps the first portion 116 of the passageway length 112, as shown in FIGS. 8 and 9. As shown in FIGS. 7 and 9, the at least one straight track 118 includes a first straight track 122 and a second straight track 124, each defined in the passageway surface 110. The second straight track 124 is positioned diametrically across the passageway 108 from the first straight track 122. In certain embodiments (not shown), the second portion 120 of the passageway length 112 is greater than the first portion 116 of the passageway length 112. In other embodiments, the at least one straight track may be shaped differently.

As shown in FIGS. 1-9, the bobbin 102 includes at least one crushable flange rib 126 disposed on an outer flange surface 128 of each of the first outer flange 104 and the second outer flange 106. As shown in FIG. 8, in the illustrated embodiment, each crushable flange rib 126 has a tapered upper portion to facilitate inserting an outer core (described below) around the bobbin.

The magnetic assembly 100 includes at least one winding 130 wound about the passageway 108 between the first outer flange 104 and the second outer flange 106. In an alternate embodiment (not shown), the at least one winding 130 includes a first and second winding separated by an intermediate flange. One of skill in the art will appreciate that multiple intermediate flanges may be used.

Figure 10:
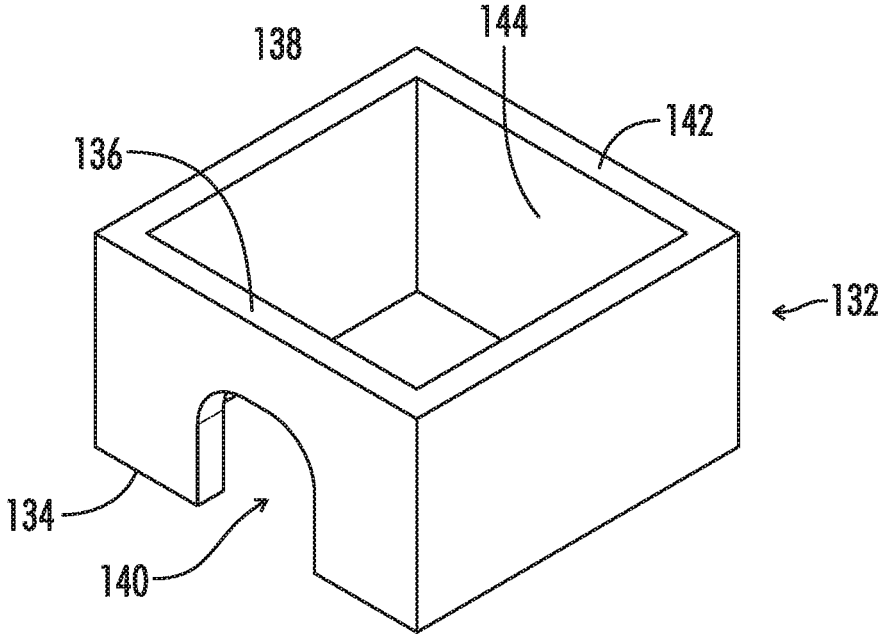
FIG. 10 illustrates a perspective view of a gapless rectangular outer core in accordance with the present disclosure.

As shown in FIGS. 1-5, the magnetic assembly 100 includes an outer core 132. The outer core 132 may be referred to as an external core 132. The outer core 132 is positionable around the bobbin 102. The outer core 132 is one continuous piece. Because the outer core 132 is one continuous piece, no stray fields are created by the outer core 132 and therefore the magnetic assembly 100 is more efficient. The outer core 132 has a lower surface 134. The outer core 132 has a first end wall 136. The first end wall 136 has a first inner surface 138 positionable adjacent to the first outer flange 104. The first end wall 136 of the outer core 132 includes an opening 140. As shown in FIG. 10, the opening 140 of the outer core is configured to extend to the lower surface 134 of the outer core 132 in the illustrated embodiment. The outer core 132 has a second end wall 142. The second end wall 142 has a second inner surface 144 positionable adjacent to the second outer flange 106.

The outer core 132 is configured to crush and frictionally engage the at least one crushable flange rib 126. As described above, the rib preferably includes a tapered upper portion to facilitate insertion of the outer core 132 around the bobbin 102. The interaction between the at least one crushable flange rib 126 and the outer core 132 secures the outer core 132 to the bobbin 102.

Figure 1:
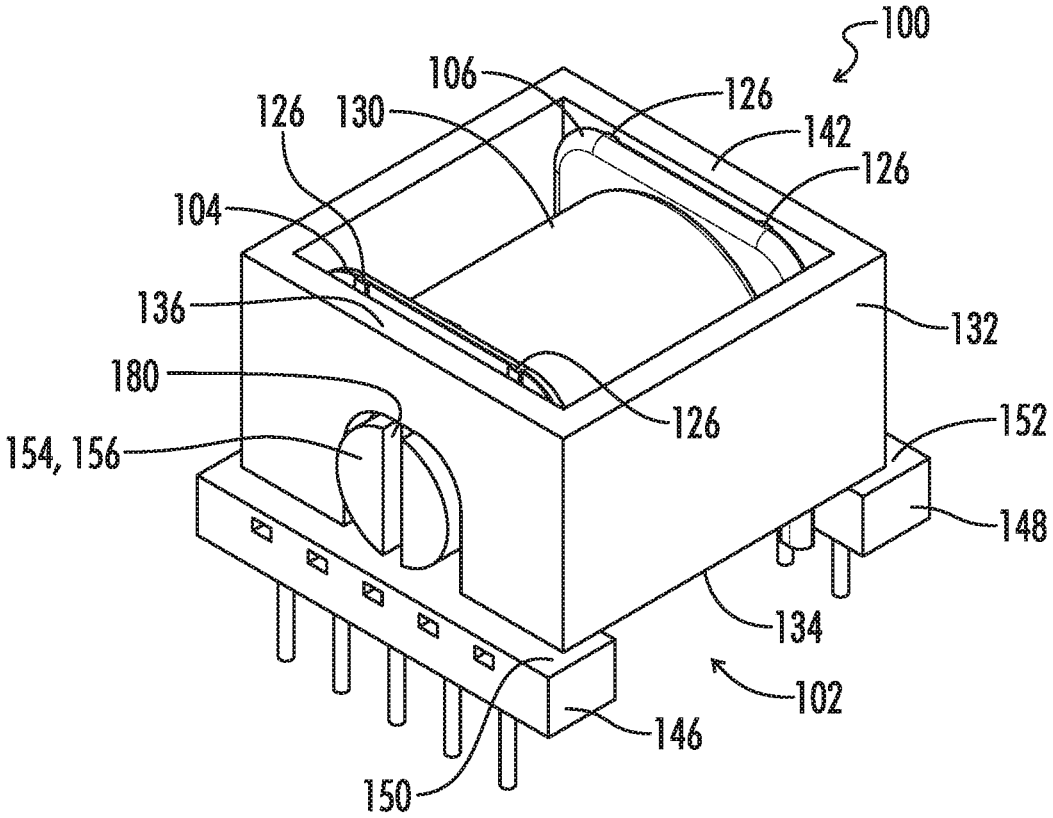
FIG. 1 illustrates a perspective view of a magnetic assembly in accordance with the present disclosure.
Figure 2:
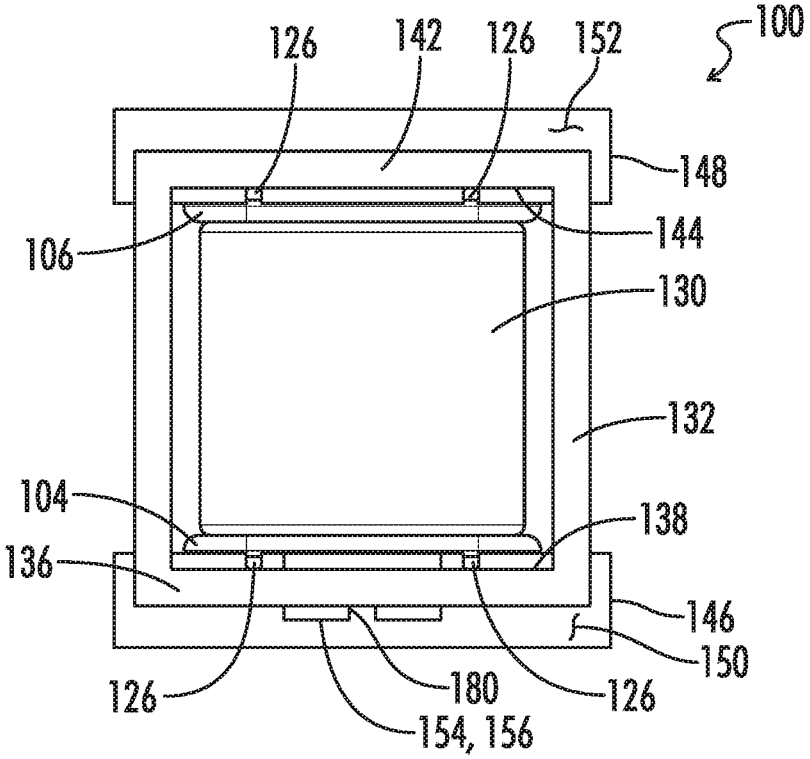
FIG. 2 illustrates a top plan view of the magnetic assembly of FIG. 1.

As shown in FIG. 1, the bobbin 102 includes a first pin rail 146 and a second pin rail 148. The first pin rail 146 is attached to the outer flange surface 128 of the first outer flange 104. The first pin rail 146 is positioned below the passageway 108 such that a first upper pin rail surface 150 aligns with the passageway surface 110. The second pin rail 148 is attached to the outer flange surface 128 of the second outer flange 106. The second pin rail 148 is positioned below the passageway 108 such that a second upper pin rail surface 152 aligns with the passageway surface 110. The lower surface 134 of the outer core 148 is configured to rest on the first upper pin rail surface 150 and the second upper pin rail surface 152.

Figure 11:
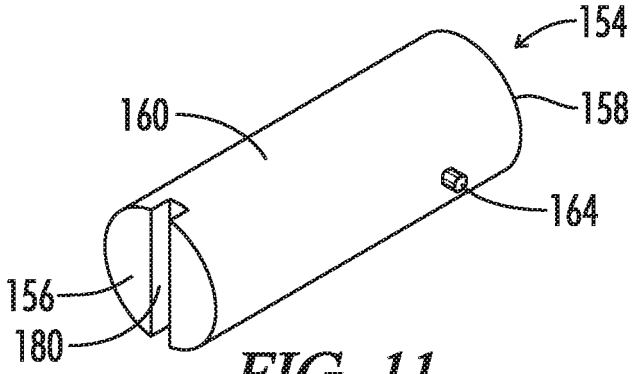
FIG. 11 illustrates a perspective view of an inner core in accordance with the present disclosure.
Figure 12:
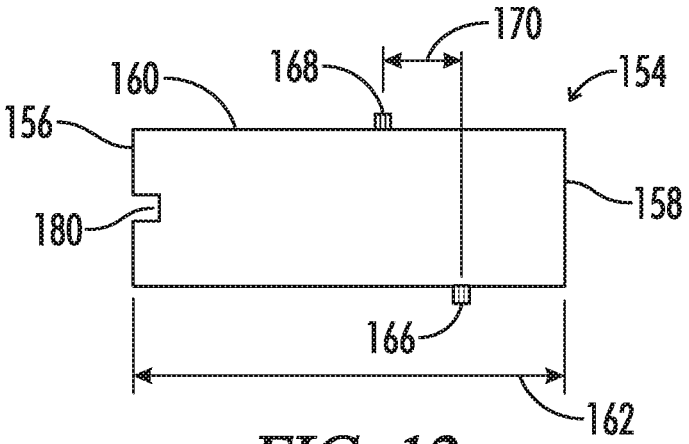
FIG. 12 illustrates a top plan view of the inner core of FIG. 11.

As shown in FIGS. 1-5, the magnetic assembly 100 includes a cylindrical inner core 154. The cylindrical inner core 154 may be referred to as an inner core 154 or a center leg core 154. The inner core 154 is positionable in the passageway 108. As shown in FIGS. 11 and 12, the inner core 154 has a first end surface 156 and a second end surface 158. The first end surface 156 is accessible through the opening 140 in the first end wall 136. In some embodiments, the first end surface 156 extends at least partially through the opening 140 of the first end wall 136. The opening 140 of the outer core 132 allows for easy access to the inner core 154. The second end surface 158 is positioned near the second end wall 142. The inner core 154 has an outer surface 160 defined between the first end surface 156 and the second end surface 158. The inner core 154 has an inner core length 162 defined along the outer surface 160 between the first end surface 156 and the second end surface 158.

Figure 3:
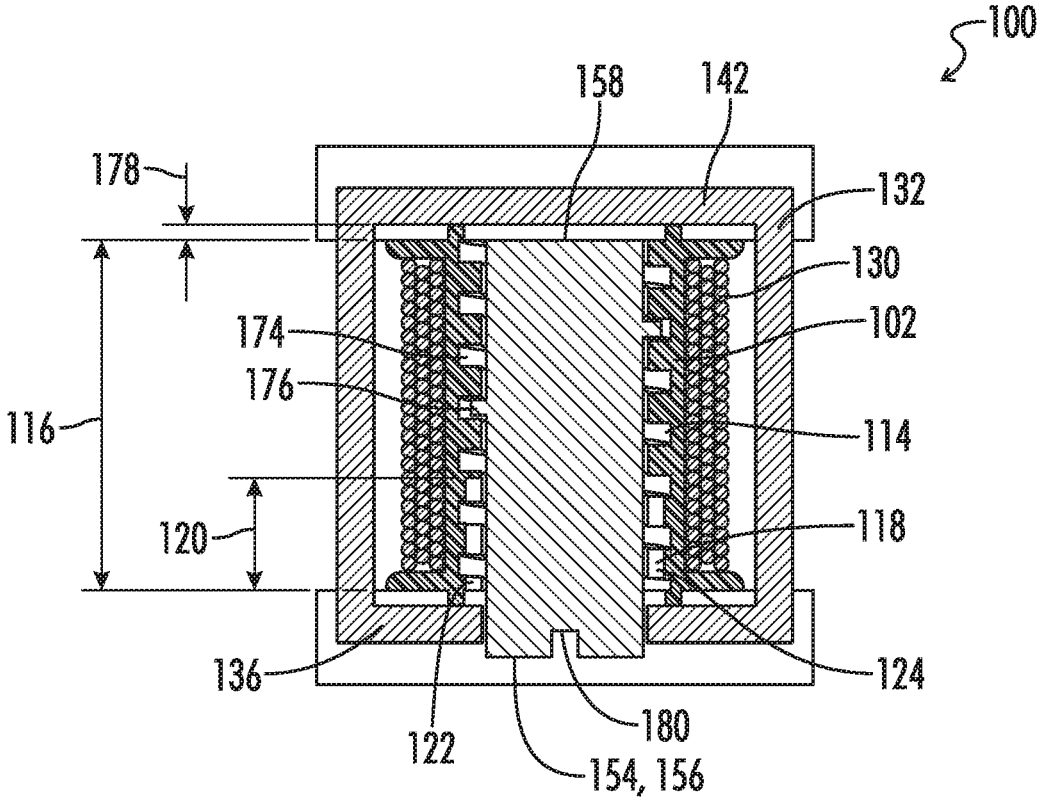
FIG. 3 illustrates a cross-sectional top plan view of the magnetic assembly of FIG. 1.
Figure 4:
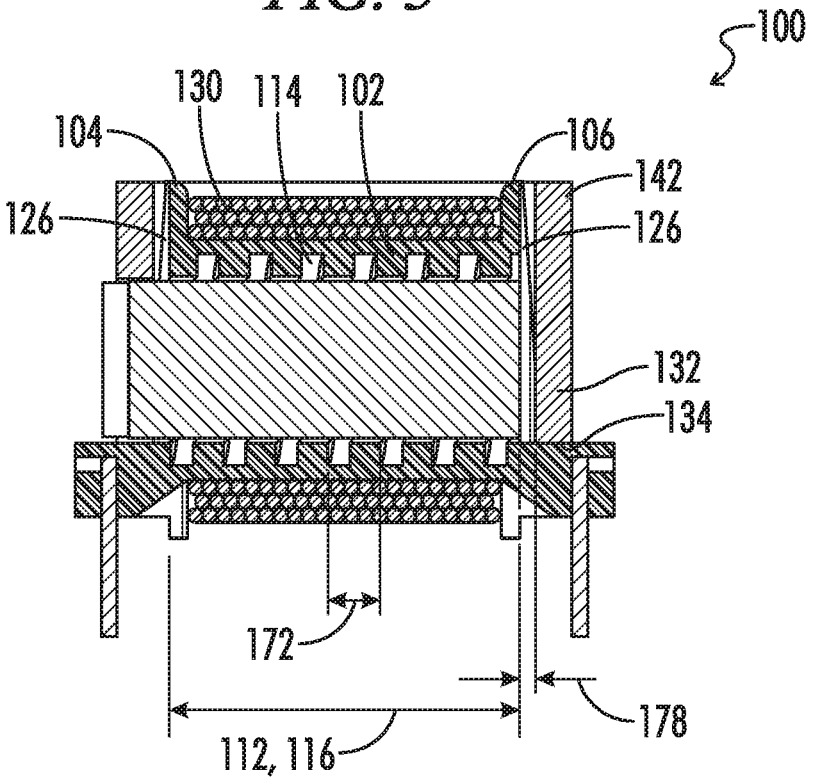
FIG. 4 illustrates a cross-sectional right side elevational view of the magnetic assembly of FIG. 1.

As shown in FIGS. 3 and 4, the inner core 154 includes at least one protrusion 164 extending from the outer surface 160. The at least one protrusion 164 is configured to slidably engage the at least one spiral track 114. The at least one protrusion 164 is configured to engage the at least one straight track 118. In the illustrated embodiment, the at least one protrusion 164 includes a first protrusion 166 and a second protrusion 168. The first protrusion 166 and the second protrusion 168 extend from opposite sides of the inner core surface 160. As shown in FIG. 12, the first protrusion 166 is offset from the second protrusion 168 by an offset distance 170 parallel with the core length 162. The offset distance 170 is configured to enable the first protrusion 166 and the second protrusion 168 to slidably engage the at least one spiral track 114.

Figure 6:
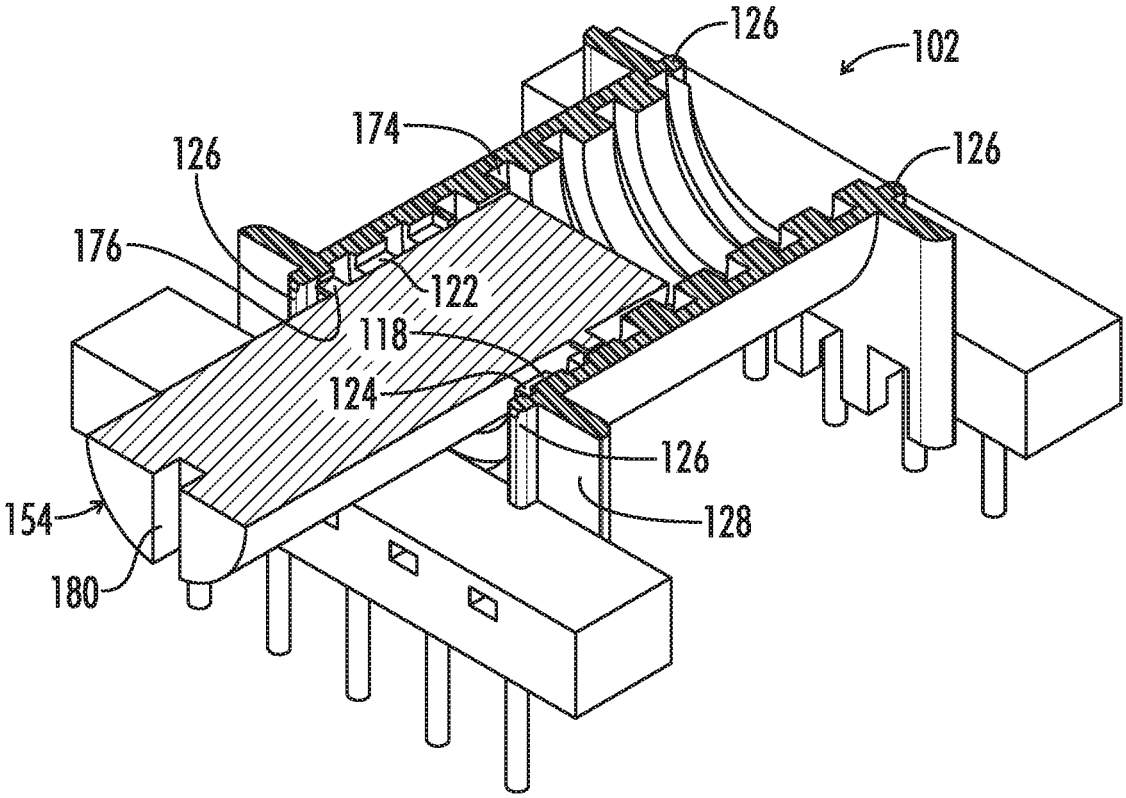
FIG. 6 illustrates a cross-sectional top perspective view of a bobbin with a center core partially inserted in accordance with the present disclosure.

In some embodiments, as shown in FIGS. 3 and 6, the offset distance 170 is related to a pitch distance 172 of one spiral of the at least one spiral track 114. The pitch distance is the longitudinal distance between corresponding angular positions along the spiral (e.g., the longitudinal distance traveled by one full turn of the spiral). The offset distance 170 is equal to any odd integer multiple of one-half the pitch distance 172. For example, the offset distance 170 may be 0.5×, 1.5×, 2.5×, 3.5×, and so on, times the pitch distance 172. In the illustrated embodiment, the offset distance 170 is equal to 1.5 times the pitch distance 172.

As shown in FIGS. 3 and 6, the at least one spiral track 114 has a track profile 174. The at last least one protrusion 164 has a protrusion profile 176 configured to enable the at least one protrusion 164 to slidably move within the at least one spiral track 114.

As shown in FIGS. 3 and 4, the magnetic assembly 100 includes a gap distance 178. The gap distance 178 is defined between the second end surface 158 of the inner core 154 and the second inner surface 144 of the outer core 132. Because the gap distance 178 is not positioned between the first outer flange 104 and the second outer flange 106, the stray fields (not shown) produced by the gap distance 178 do not create unwanted winding losses. The gap distance 178 is adjustable through engagement of the at least one protrusion 164 with the at least one spiral track 114.

In the illustrated embodiment, the first end surface 156 includes a drive interface 180. The drive interface 180 is shown in FIGS. 1, 5, and 6. The drive interface 180 is engageable with an engagement tool (not shown) to move the at least one protrusion 164 within the at least one spiral track 114. For example, the engagement tool may be a conventional flat head screwdriver or other similar instrument. The drive interface 180 is turned to selectively adjust the gap distance 178. Turning the drive interface 180 moves the at least one protrusion 164 within the at least one spiral track 114 to adjust the gap distance 178.

Adjustment of the gap distance 178 adjusts the inductance of the magnetic assembly 100. The magnetic assembly 100 is tuned by increasing or decreasing the gap distance 178. Increasing the gap distance 178 decreases the inductance of the magnetic assembly 100. Decreasing the gap distance 178 increases the inductance of the magnetic assembly 100. In the illustrated embodiment, turning the inner core 154 counterclockwise increases the gap distance 178. Turning the inner core 154 clockwise decreases the gap distance 178.

The tunable magnetic assembly can be used in circuits which require very tight inductance tolerances. They can also be very helpful in the prototyping design stage. The inductance can easily be tuned to maximize the performance of the circuit. The inductance can also be varied to investigate what changes in inductance does to the performance of the circuit.

Particular embodiments of the present invention of a new and useful TUNABLE MAGNETIC STRUCTURE are described herein; however, such references are not to be construed as limitations upon the scope of this invention except as set forth in the following claims.

What is claimed is:

1. A tunable magnetic assembly comprising:

a bobbin comprising a first end flange, a second end flange, a cylindrical passageway extending through the bobbin from the first end flange to the second end flange, the passageway having a passageway surface and a passageway length defined between the first end flange and the second end flange, the passageway further having at least one spiral track etched in the passageway surface along a first portion of the passageway length, and at least one straight track etched in the passageway surface, the at least one straight track spanning a second portion of the passageway length, the second portion at least partially overlapping the first portion of the passageway length;

an outer core positionable around the first and second end flanges, the outer core having a first end wall having a first inner surface adjacent to the first end flange, the first end wall including an opening, the outer core having a second end wall having a second inner surface adjacent to the second end flange; and a cylindrical inner core positionable in the passageway of the bobbin, the cylindrical inner core having a first end surface, a second end surface, and an outer surface defined between the first end surface and the second end surface, the first end surface accessible through the opening in the first end wall, the second end surface positionable near the second end wall, wherein the cylindrical inner core further includes at least one protrusion extending from the outer surface configured to engage the at least one spiral track, and wherein a gap distance is defined between the second end surface of the cylindrical inner core and the second inner surface of the outer core.

2. The tunable magnetic assembly of claim 1, wherein the gap distance is adjustable.

3. The tunable magnetic assembly of claim 1, further comprising at least one winding wound about the passageway between the first end flange and the second end flange.

4. The tunable magnetic assembly of claim 1, wherein the cylindrical inner core further comprises a drive interface on the first end surface, the drive interface engageable with an engagement tool to selectively move the at least one protrusion within the at least one spiral track.

5. The tunable magnetic assembly of claim 1, wherein the at least one spiral track has a track profile, and wherein the at least one protrusion has a protrusion profile such that the at least one protrusion is configured to move within the at least one spiral track.

6. The tunable magnetic assembly of claim 1, wherein the at least one protrusion of the inner core includes a first protrusion and a second protrusion extending from an opposite side of the outer surface, and wherein the first and second protrusions are offset by an offset distance parallel with an inner core length.

7. The tunable magnetic assembly of claim 6, wherein the offset distance is configured to enable both the first protrusion and the second protrusion to engage the at least one track.

8. The magnetic assembly of claim 1, wherein the first end surface of the cylindrical inner core extends at least partially through the opening of the first end wall of the outer core.

9. The tunable magnetic assembly of claim 1, wherein the opening is configured to extend to a lower surface of the outer core.

10. The tunable magnetic assembly of claim 1, wherein the at least one straight track includes a first straight track and a second straight track positioned diametrically across the passageway from the first straight track.

11. The tunable magnetic assembly of claim 1, the bobbin further comprising at least one crushable flange rib disposed on an outer flange surface of each of the first and second end flanges.

12. The tunable magnetic assembly of claim 11, wherein the at least one crushable flange rib is tapered.

13. The tunable magnetic assembly of claim 11, wherein the outer core is configured to crush and frictionally engage the at least one crushable flange rib to secure the outer core to the bobbin.

* * * * *